US009017234B2

(12) United States Patent
Tai et al.

(10) Patent No.: US 9,017,234 B2
(45) Date of Patent: Apr. 28, 2015

(54) WATER RESISTANCE UPPER BODY RECIPROCATING EXERCISER

(71) Applicant: Southern Taiwan University of Science and Technology, Tainan (TW)

(72) Inventors: Tzu-Yao Tai, Tainan (TW); Cheng-Yu Kuo, Tainan (TW)

(73) Assignee: Southern Taiwan University of Science and Technology, Tainan (TW)

( * ) Notice: Subject to any disclaimer, the term of this patent is extended or adjusted under 35 U.S.C. 154(b) by 97 days.

(21) Appl. No.: 14/036,402

(22) Filed: Sep. 25, 2013

(65) Prior Publication Data

US 2014/0249003 A1 Sep. 4, 2014

(30) Foreign Application Priority Data

Mar. 1, 2013 (TW) ..... 102107306 U

(51) Int. Cl.
*A63B 21/008* (2006.01)

(52) U.S. Cl.
CPC ..... *A63B 21/0083* (2013.01)

(58) Field of Classification Search
CPC ..... A63B 21/00036; A63B 21/008; A63B 21/0081; A63B 21/0083; A63B 21/0084; A63B 21/0085; A63B 21/0087; A63B 21/0088
See application file for complete search history.

(56) References Cited

U.S. PATENT DOCUMENTS

| | | | | | |
|---|---|---|---|---|---|
| 3,369,403 | A * | 2/1968 | Carlin et al. | ..... | 482/113 |
| 4,969,643 | A * | 11/1990 | Kroeker et al. | ..... | 482/112 |
| 4,981,199 | A * | 1/1991 | Tsai | ..... | 188/312 |
| 5,058,887 | A * | 10/1991 | Patterson | ..... | 482/113 |
| 5,330,406 | A * | 7/1994 | Patterson | ..... | 482/113 |
| 5,364,326 | A * | 11/1994 | Smith et al. | ..... | 482/113 |
| 2007/0287612 | A1 * | 12/2007 | Cha | ..... | 482/111 |

FOREIGN PATENT DOCUMENTS

| | | |
|---|---|---|
| TW | 383592 | 8/1987 |
| TW | M401461 U1 | 4/2011 |
| TW | M424170 U1 | 3/2012 |

* cited by examiner

*Primary Examiner* — Oren Ginsberg
(74) *Attorney, Agent, or Firm* — Rosenberg, Klein & Lee

(57) ABSTRACT

An upper body reciprocating exerciser includes a frame having a post. A cam is connected to the post and has a guide slot which is cooperated with a piston rod of a cylinder. An enclosed loop pipe is connected to outside of the cylinder and includes two sets of a check valve and an adjustable control valve. The loop pipe communicates with a space in the cylinder. The check valves and the adjustable control valves control fluid in the cylinder to adjust the resistance force when a user pulls a pull unit, so that the user's bones and muscles are exercised properly.

10 Claims, 7 Drawing Sheets

WATER RESISTANCE UPPER BODY RECIPROCATING EXERCISER

BACKGROUND OF THE INVENTION

1. Fields of the Invention

The present invention relates to an exerciser, and more particularly, to an upper body reciprocating exerciser by using water resistance and cam to exercise the muscles of upper body.

2. Description of Related Art

The upper body is generally used to pick and operate objects, and the lower body is generally used to walk and move. The basic component of the upper and lower bodies is bones and muscles, the bones and muscles can be reinforced by taking exercises. However, most of the people do not have time to take exercises because of the life style, especially for aged people. For most of retired people, if they did not build an exercising mode during the everyday life, the bones and muscles may quickly turn down and even affect their health condition. There are different exercisers provided to help these people to reinforce the muscles and bones.

Taiwan Utility Model No. M401461 discloses an upper body exerciser and comprises a frame fixed to a wall, a vertical part connected to the frame, a horizontal part connected to the top of the vertical part, and a pulley unit connected to the front end of the horizontal part. Two pulleys are connected to two ends of the pulley unit and a cable reeves the pulleys. Two handles are connected to the two ends of the cable. When it is used, a user holds the handles and pulls the cable to exercise the muscles of the arms. However, there is no proper resistance to be overcome during the exercising, so that the muscles do not exercised and the result is not satisfied.

Taiwan Utility Model No. M424170 discloses another upper body exerciser and comprises a frame, a pulley unit, a resistance unit and a pull unit, wherein the frame has a post through which multiple holes are defined. The pulley unit is connected to the frame. The resistance unit comprises multiple weights and a slide member. The pull unit has a movable member which is movably mounted to the post and positioned at a desired position by inserting a pin in one of the holes in the post. Taiwan Publish No. 383592 discloses an exerciser which allows the user to exercise the hands or legs. There are two hydraulic cylinders communicated with each other so that the user can adjust the fluid in the cylinders to adjust the level of the resistance.

Although Taiwan Utility Model No. M424170 and Taiwan Publish No. M383592 both are equipped with the resistance unit, the weights used in Taiwan Utility Model No. M424170 may be too heavy so that the aged users can be injured during use. The impact between the weights also generates noise which makes the users feel uncomfortable. If the exerciser is installed in outdoor, the weights may be stolen and the exerciser is easily damaged, so that it is not suitable for being installed in publish areas such parks. Taiwan Publish No. 383592 uses hydraulic power as the source of resistance, the hydraulic liquid in the cylinders may leak and contaminate the environment.

The present invention intends to provide an upper body reciprocating exerciser by using water resistance and cam to exercise the muscles of upper body, the exerciser of the present invention improves the shortcomings mentioned above.

SUMMARY OF THE INVENTION

The present invention relates to an upper body reciprocating exerciser and comprises a frame having a post. A transmission unit is connected to the post and has a cam which is a disk cam. A guide slot is defined in one face of the cam and a passive member is located in the guide slot so as to be connected with a first end of a piston rod. A piston is connected to a second end of the piston rod. A shaft extends through the cam and is connected to the post. A resistance unit is connected to the post of the frame and has a cylinder which has a space defined therein. The piston and the piston rod are located in the space. The piston divides the space into a top room and a bottom room. An enclosed loop pipe is connected to outside of the cylinder. A top pipe is connected between a top portion of the loop pipe and the top room of the cylinder. A bottom pipe is connected between a lower portion of the loop pipe and the bottom room of the cylinder. The loop pipe has a down-flow section and an up-flow section. Each of the down-flow section and the up-flow section has a check valve and an adjustable control valve. The check valve in the down-flow section and the check valve in the up-flow section are installed in opposite directions. Water is filled in the space of the cylinder. A pull unit has a socket which is connected to an end of the shaft. The socket has a bar connected thereto, and two handles 45 connected to two ends of the bar.

Preferably, the guide slot of the cam is shaped as a semi-oval curve.

Preferably, the check valve and the adjustable control valve in the down-flow section of the resistance unit are arranged such that the check valve is located above the adjustable control valve. The check valve and the adjustable control valve in the up-flow section of the resistance unit are arranged such that the adjustable control valve is located above the check valve.

Preferably, the transmission unit has a sleeve which is mounted to a top of the post of the frame so as to secure the shaft. A disk is connected to an end of the shaft and located in opposite to the pull unit. The disk has a restriction slot in which an extension extending from the sleeve is inserted.

Preferably, the restriction slot of the disk is a curved slot with an angle of 130 degrees defined between two extensions of the restriction slot.

Preferably, a base is connected to a lower end of the post and two support parts are laterally connected to the lower end of the post.

Preferably, the post is a hollow post and has a notch defined in the top end thereof. The cam of the transmission unit is located in the notch. The piston rod and the piston of the transmission unit, and the resistance unit are located in a space of the post. An opening is defined through a wall of the post and communicates with the space of the post. The resistance unit is located in the opening.

Preferably, a pivotal member and a cable are connected between the bar and each of the handles. The pivotal member is connected between the bar and the cable. The cable is connected between the pivotal member and the handle.

The cam of the exerciser is cooperated with the check valves and the adjustable control valves in the loop pipe of the cylinder to control the direction and volume of the water in the cylinder to ensure that when the cam drives the piston rod, the piston is moved in the cylinder to generate proper pressure so as to provide the resistance in opposite direction to the force from the user so as to exercise the muscles and bones of the users.

The present invention uses water as the source of resistance of the exerciser and water is less expensive than hydraulic fluid. Even if the water leaks, it is not harm the environment so that the present invention is suitable to be set in public areas such as parks.

The present invention includes the post and two support parts to firmly support the present invention on the ground. The two support parts can be used as chairs or stools so that the friends can sit on the support parts to accompany the user.

The disk of the present invention has a restriction slot in the disk connected to the rear end of the shaft so that when the user pulls the handles to rotate the shaft, the restriction slot cooperates with the extension of the sleeve to restrict the angle that the shaft rotates so as to protect the user from injury.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
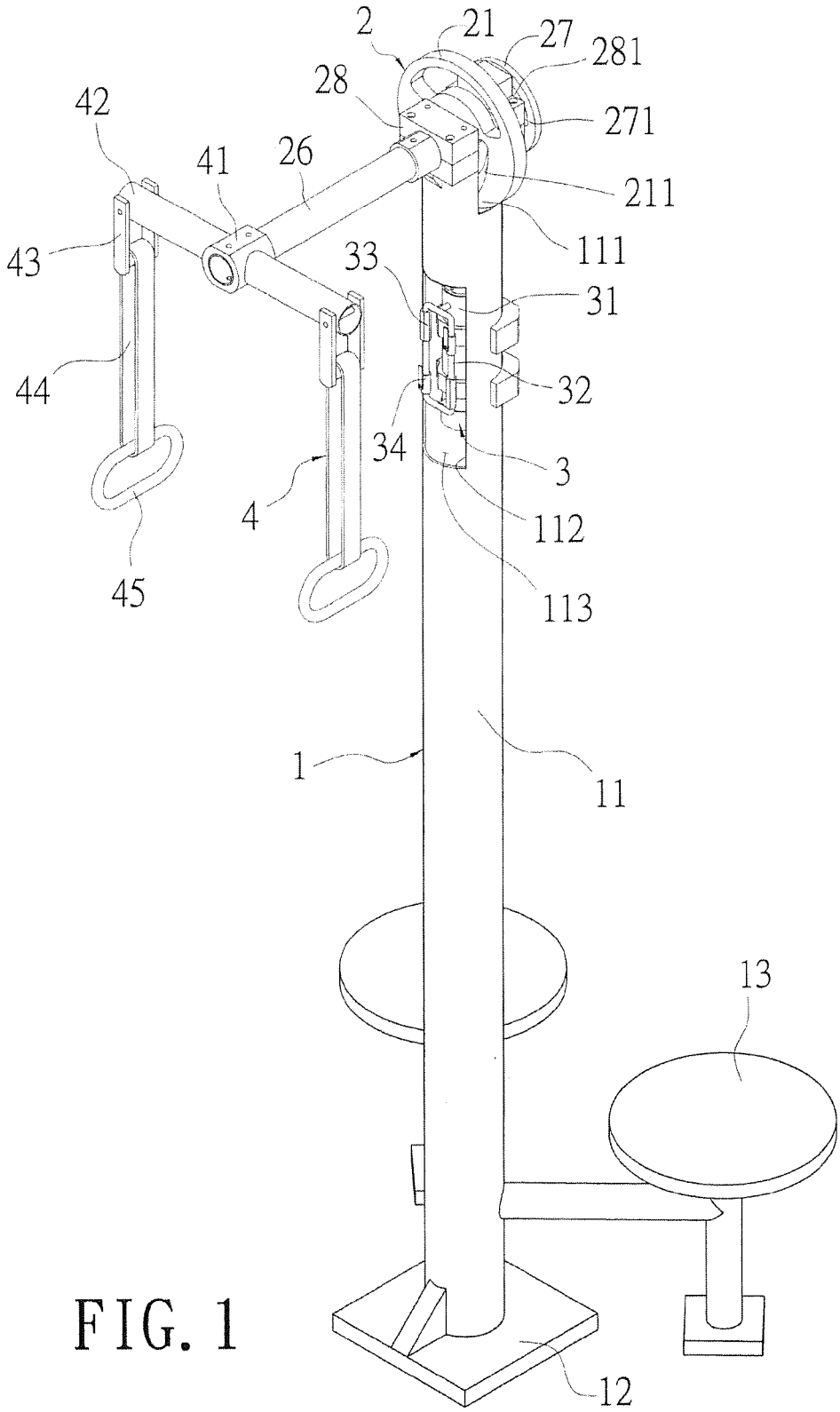
FIG. 1 is a perspective view to show the upper body reciprocating exerciser of the present invention.
Figure 2:
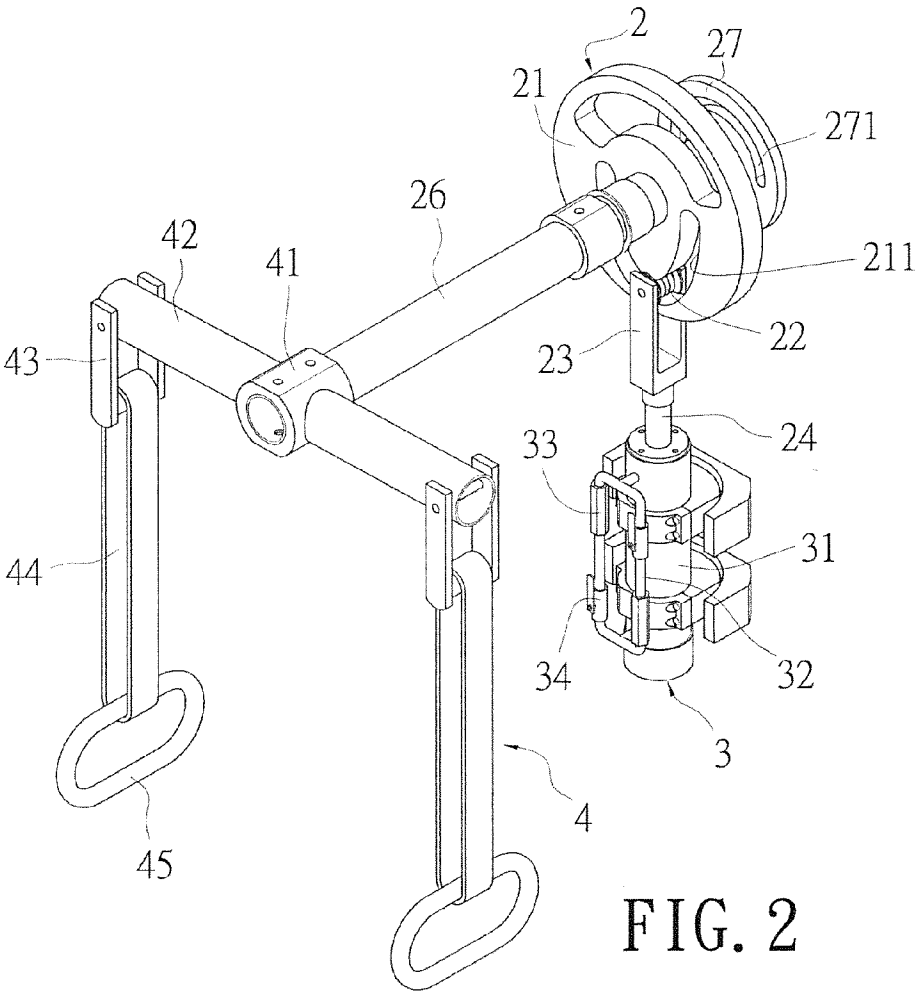
FIG. 2 is an enlarged perspective view to show a portion of the upper body reciprocating exerciser of the present invention.

Referring to FIGS. 1 and 2, the upper body reciprocating exerciser of the present invention comprises a frame 1, a transmission unit 2, a resistance unit 3 and a pull unit 4.

The frame 1 has a post 11 which is a hollow post and has a notch 111 defined in the top end thereof. An opening 112 is defined through a wall of the post 11 and communicates with a space 113 of the post 11. A rectangular base 12 is connected to the lower end of the post 11 and two support parts 13 are laterally connected to the lower end of the post 11. An angle of 120 degrees is defied between the two support parts 13.

The transmission unit 2 has a cam 21 which is a disk cam and located in the notch 111 of the post 11. A guide slot 211 is defined in one face of the cam 21 and a passive member 22 is located in the guide slot 211. The guide slot 211 of the cam 21 is shaped as a semi-oval curve. The passive member 22 is connected with a fork 23 which is connected with the first end of a piston rod 24. A piston 25 is connected to the second end of the piston rod 24. The fork 23, the piston rod 24 and the piston 25 are located in the space 113 of the post 11. A shaft 26 extends through the center of the cam 21 and is connected to the post 11. A disk 27 is connected to one end of the shaft 26 and located in opposite to the pull unit 4. The disk 27 has a restriction slot 271 which is a curved slot with an angle of 130 degrees defined between two extensions of the restriction slot 271. The transmission unit 2 has a sleeve 28 which is mounted to the top of the post 11 of the frame 1 so as to secure the shaft 26. An extension 281 extends from the sleeve 28 and is inserted into the restriction slot 271 of the disk 27.

Figure 3:
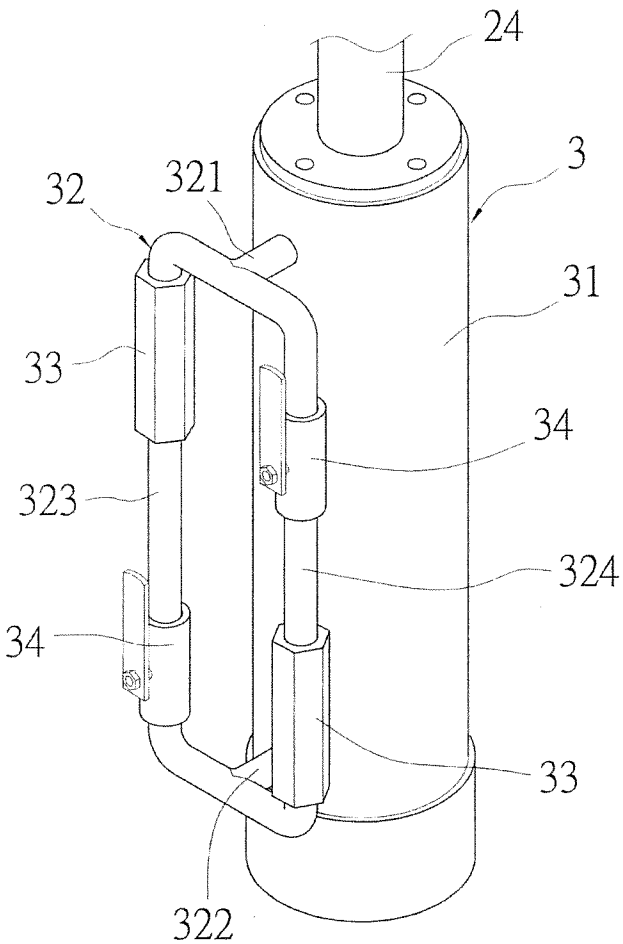
FIG. 3 is an enlarged perspective view to show the resistance unit of the upper body reciprocating exerciser of the present invention.
Figure 5:
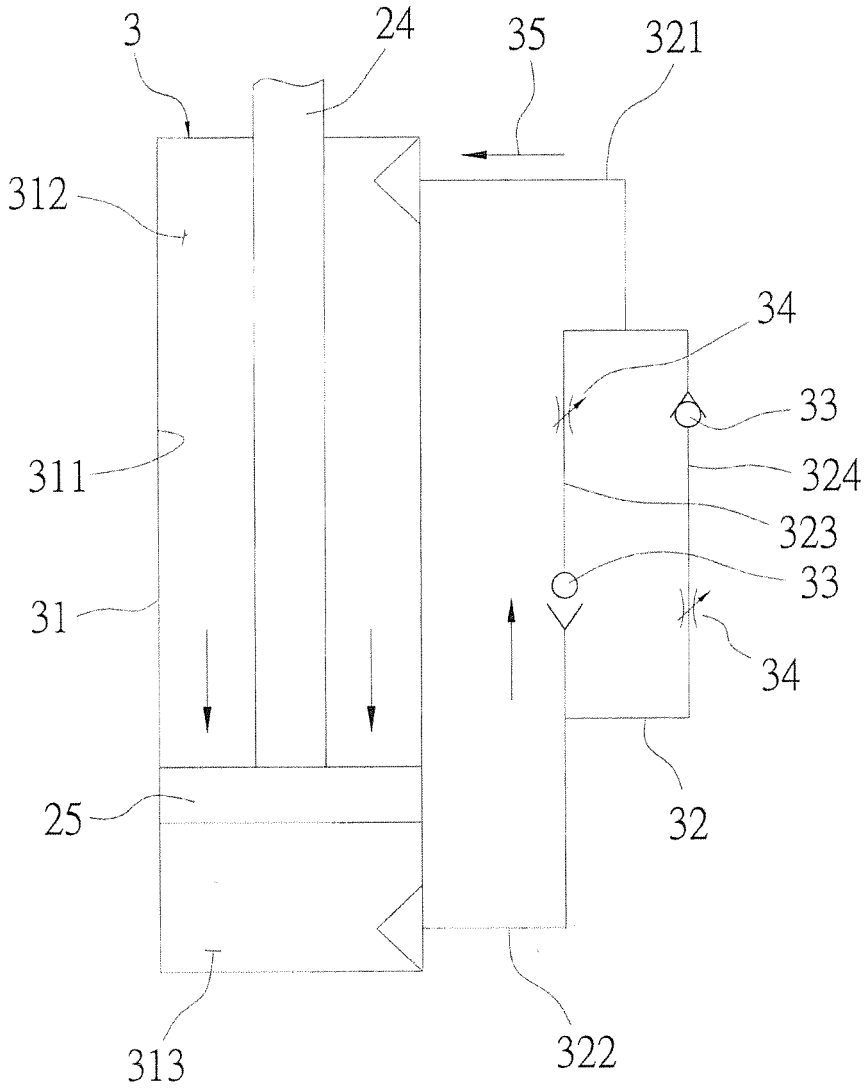
FIG. 5 shows the water flowing path when the piston moves downward.

As shown in FIGS. 3 and 5, the resistance unit 3 is connected to the post 11 of the frame 1 and comprises a cylinder 31 which is located in the space 113 of the post 11 and positioned at the opening 112 of the post 11. The cylinder 31 has a space 311 defined therein, the piston 25 and the piston rod 24 are located in the space 311. The piston 25 divides the space 311 into a top room 312 and a bottom room 313. An enclosed loop pipe 32 is connected to outside of the cylinder 31. A top pipe 321 is connected between the top portion of the loop pipe 32 and the top room 312 of the cylinder 31, and a bottom pipe 322 is connected between the lower portion of the loop pipe 32 and the bottom room 313 of the cylinder 31. The loop pipe 32 has a down-flow section 323 and an up-flow section 324 on two sides thereof. Each of the down-flow section 323 and the up-flow section 324 has a check valve 33 and an adjustable control valve 34. The check valve 33 in the down-flow section 323 and the check valve 33 in the up-flow section 324 are installed in opposite directions. In detail, the check valve 33 and the adjustable control valve 34 in the down-flow section 323 of the resistance unit 3 are arranged such that the check valve 33 is located above the adjustable control valve 34. The check valve 33 and the adjustable control valve 34 in the up-flow section 324 of the resistance unit 3 are arranged such that the adjustable control valve 34 is located above the check valve 33. Fluid 35 is filled in the space 311 of the cylinder 31 and the fluid 35 is water.

The pull unit 4 has a socket 41 which is connected to the front end of the shaft 26. The socket 41 has a bar 42 connected thereto, and two handles 45 are connected to two ends of the bar 42. In detail, a pivotal member 43 and a cable 44 are connected between the bar 2 and each of the handles 45. The pivotal member 43 is connected between the bar 42 and the cable 44, the cable 44 is connected between the pivotal member 43 and the handle 45.

The exerciser of the present invention can be installed to outdoor sites such as parks so that the peoples such as elders can easily use the exerciser. The rectangular base 12 is connected to the lower end of the post 11 and two support parts 13 are laterally connected to the lower end of the post 11. An angle of 120 degrees is defied between the two support parts 13. The base 12 and the two support parts 13 form a firm three points so that the post 11 of the exerciser can be firmly installed to the ground of the parks.

Figure 4:
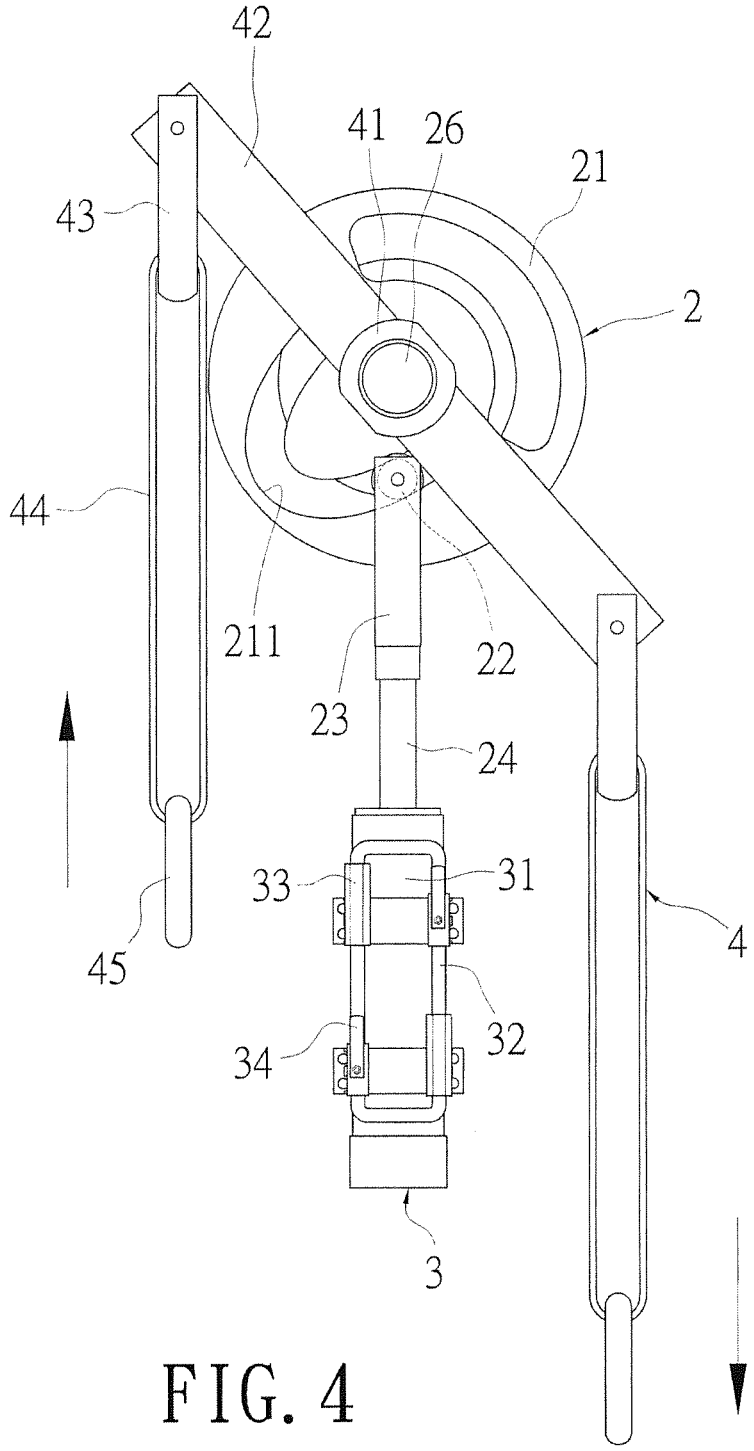
FIG. 4 shows the operation status of the upper body reciprocating exerciser of the present invention.

When in use, as shown in FIG. 4, the user holds the two handles 45 of the pull unit 4, the upper body and the two hands apply two forces in opposite directions to the handles 45 to operate the two handles up and down alternatively. When one handle 45 is pulled downward, the cable 44 and one end of the bar 42 are moved downward, the shaft 26 of the transmission unit 2 that is connected to the bar 42 is rotated clockwise. The cam 21 that is connected to the shaft 26 is rotated clockwise so that the passive member 22 in the guide slot 211 of the cam 21 moves from one end of the guide slot 211 to the other end. The passive member 22 moves upward from one end of the guide slot 211 and passes through the peak point of the guide slot 211 and then reaches the other end of the guide slot 211.

When the passive member 22 moves upward in the guide slot 211, as shown in FIG. 5, the piston rod 24 is driven by the fork 23 and the piston 25 is moved from the top room 312 to the bottom room 313 in the space 311 of the cylinder 31. The fluid 35 in the space 311 is pushed when the piston 25 is moved from the top room 312 to the bottom room 313 so that the fluid 35 generates resistance relative to the piston 25. Therefore, the user's muscles and bones are exercised when the handle 45 is pulled downward by the resistance.

When the piston 25 is moved from the top room 312 to the bottom room 313 in the space 311 of the cylinder 31, the fluid 35 in the bottom room 313 is pushed by the piston 25 and flows into the loop pip 32 via the bottom pipe 322. Because the check valve 33 and the difference of pressure in the loop pipe 32, the fluid 35 passes through the check valve 33 of the flow-down section 323 and enters into the top room 312 of the space 311 of the cylinder 31 via the top pipe 321. When the passive member 22 passes through the peak point of the guide slot 211, the piston 25 reaches the lowest point in the bottom room 313 of the space 311 of the cylinder 31.

Figure 6:
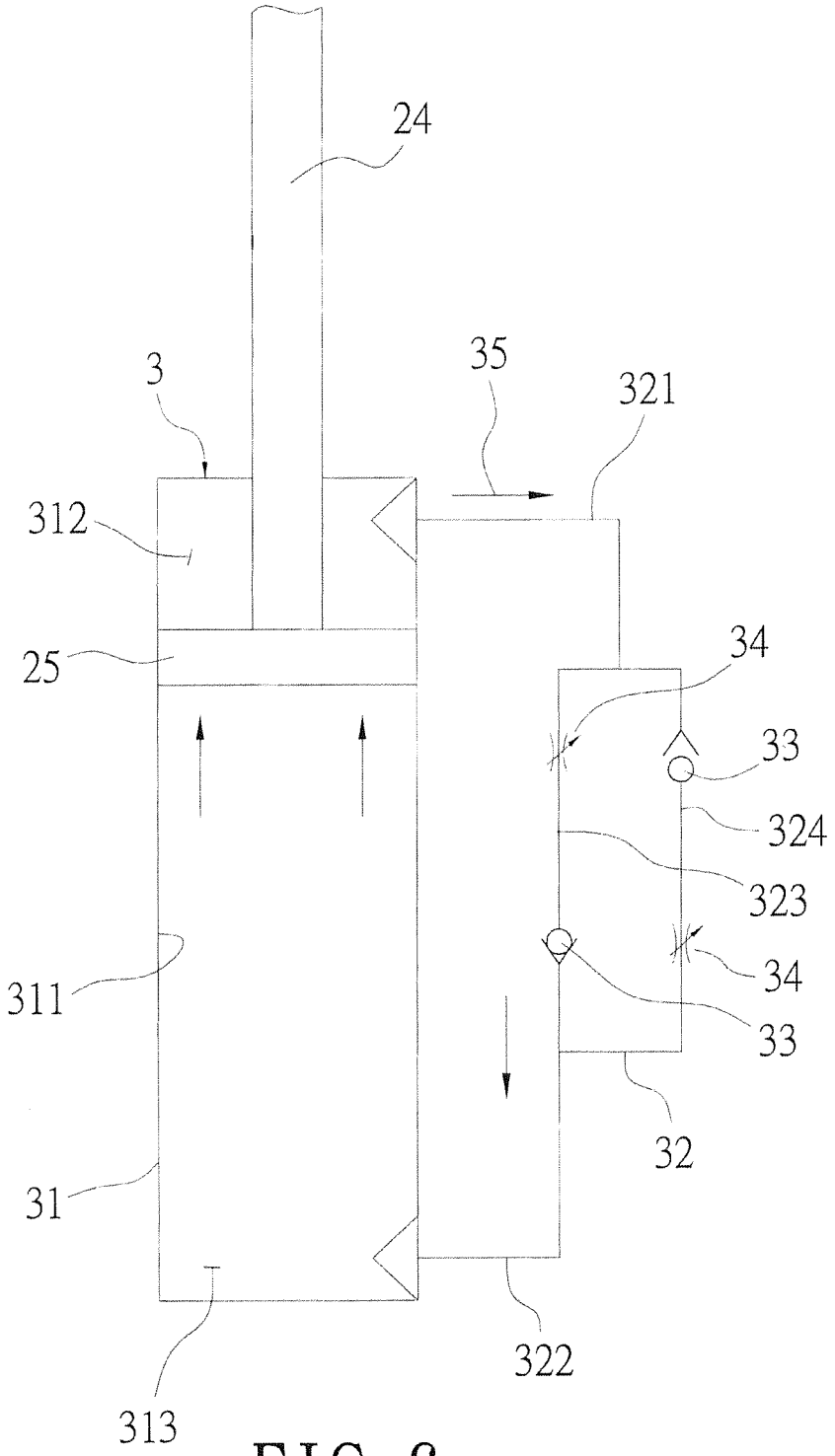
FIG. 6 shows the water flowing path when the piston moves upward.

Referring to FIG. 6, when the passive member 22 passes over the peak point of the guide slot 211, the passive member 22 starts to move backward, the passive member 22 and the piston 25 are not restricted by the guide slot 211, and the fluid 35 in the top room 312 of the space 311 of the cylinder 31, affected by the difference of pressure, flows through the top pipe 321, the check valve 33 of the up-flow section 324 of the loop pipe 32, the bottom pipe 322 and then flows into the bottom room 313 which has lower pressure, until a pressure balance is reached between the top room 312 and the bottom room 313 in the space 311 of the cylinder 31. When the fluid 35 flows back into the bottom room 313, the piston 25 is pushed upward by the fluid 35 in the bottom room 313. When the pressure balance is reached between the top room 312 and the bottom room 313 in the space 311 of the cylinder 31, the piston 25 moves back to its initial position.

Figure 7:
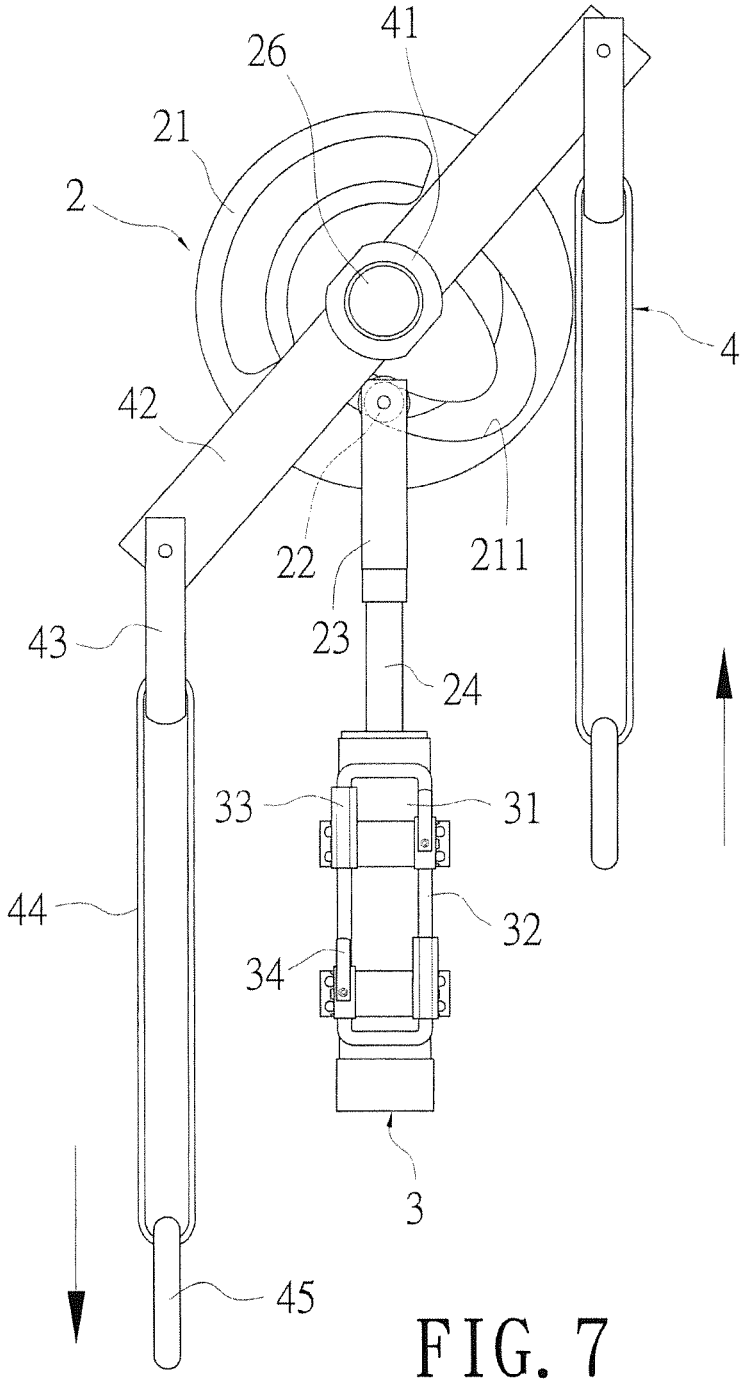
FIG. 7 shows another operation status of the upper body reciprocating exerciser of the present invention.

Furthermore, when the user pulls one handle 45 downward, and the other handle 45 moves upward, when the handle 45 reaches the lowest point, the other handle 45 reaches the highest point. As shown in FIG. 7, when the user pulls down the handle 45 at the highest point, the end of the bar 42 that is connected with the downward movement handle 45 moves downward. The shaft 26 is rotated counter clockwise and the cam 21 is rotated counter clockwise. The passive member 22 in the guide slot 211 moves from one end to the other end of the guide slot 211. When the passive member 22 in the guide slot 211 moves from one end to the other end of the guide slot 211, the resistance unit 3 is repeatedly operated to generate resistance to exercise the muscles and bones of the other hand of the user.

When the user pulls the two handles 45 of the pull unit 4 to rotate the shaft 26 via the bar 42 in two opposite directions, referring to FIGS. 1 and 2, the restriction slot 271 of the disk 27 on the rear end of the shaft 26 is cooperated with the extension 281 to restrict the shaft 26 to be rotated between positive and negative 65 degrees. By this arrangement, the user is not injured by overly pulling the two handles 45.

When the user wants to adjust the resistance from the resistance unit 3, the resistance can be increased by reducing the volume of the fluid 35 passing through the adjustable control valve 34, vice versa. By this specific feature, different users can operate the exerciser of the present invention with proper resistance by adjusting the adjustable control valve 34 so as to avoid injury. The fluid 35 used in the exerciser of the present invention is water, so that even when the fluid 35 leaks, the water is not harmful to the environment of the parks. The frame 1 and two support parts 13 connected to the post 11 can firmly support the exerciser of the present invention on the ground. The two support parts 13 can also be used as chairs or stools so that the friends can sit on the support parts 13 to accompany the user.

The present invention has the following advantages:

The cam 21 of the exerciser is cooperated with the check valves 33 and the adjustable control valves 34 in the loop pipe 32 of the cylinder 31 to control the direction and volume of the water in the cylinder 31 to ensure that when the cam 21 drives the piston rod 24, the piston 25 is moved in the cylinder 31 to generate proper pressure so as to provide the resistance in opposite direction to the applied force from the user so as to exercise the muscles and bones of the users.

The present invention uses water as the source of resistance of the exerciser and water is less expensive than hydraulic fluid. Even if the water leaks, it is not harmful to the environment so that the present invention is suitable to be set in public areas such as parks.

The present invention includes the post 11 and two support parts 13 to firmly support the present invention on the ground. The two support parts 13 can be used as chairs or stools so that the friends can sit on the support parts to accompany the user.

The present invention has a disk 27 connected to the rear end of the shaft 26 and the disk 27 has a restriction slot 271, so that when the user pulls the handles 45 to rotate the shaft 26, the restriction slot 271 cooperates with the extension 281 of the sleeve 28 to restrict the angle that the shaft 26 rotates so as to protect the user from injury.

While we have shown and described the embodiment in accordance with the present invention, it should be clear to those skilled in the art that further embodiments may be made without departing from the scope of the present invention.

What is claimed is:

1. An upper body reciprocating exerciser, comprising:

a frame having a post;

a transmission unit connected to the post and having a cam which is a disk cam, a guide slot defined in one face of the cam and a passive member located in the guide slot, the passive member connected with a first end of a piston rod, a piston connected to a second end of the piston rod, a shaft extending through the cam and connected to the post;

a resistance unit connected to the post of the frame and having a cylinder which has a space defined therein, the piston and the piston rod located in the space, the piston dividing the space into a top room and a bottom room, an enclosed loop pipe connected to outside of the cylinder, a top pipe connected between a top portion of the loop pipe and the top room of the cylinder, a bottom pipe connected between a lower portion of the loop pipe and the bottom room of the cylinder, the loop pipe having a down-flow section and an up-flow section, each of the down-flow section and the up-flow section having a check valve and an adjustable control valve, the check valve in the down-flow section and the check valve in the up-flow section being installed in opposite directions, water being filled in the space of the cylinder, and a pull unit having a socket which is connected to an end of the shaft, the socket having a bar connected thereto, two handles connected to two ends of the bar.

2. The exerciser as claimed in claim 1, wherein the guide slot of the cam is shaped as a semi-oval curve.

3. The exerciser as claimed in claim 2, wherein the transmission unit has a sleeve which is mounted to a top of the post of the frame so as to secure the shaft, a disk is connected to an end of the shaft and located in opposite to the pull unit, the disk has a restriction slot in which an extension extending from the sleeve is inserted.

4. The exerciser as claimed in claim 3, wherein the check valve and the adjustable control valve in the down-flow section of the resistance unit are arranged such that the check valve is located above the adjustable control valve, the check valve and the adjustable control valve in the up-flow section of the resistance unit are arranged such that the adjustable control valve is located above the check valve.

5. The exerciser as claimed in claim 1, wherein a base is connected to a lower end of the post and two support parts are laterally connected to the lower end of the post.

6. The exerciser as claimed in claim 1, wherein the post is a hollow post and has a notch defined in the top end thereof, the cam of the transmission unit is located in the notch, the piston rod and the piston of the transmission unit, and the resistance unit are located in a space of the post, an opening is defined through a wall of the post and communicates with the space of the post, the resistance unit is located in the opening.

7. The exerciser as claimed in claim 1, wherein the transmission unit has a sleeve which is mounted to a top of the post of the frame so as to secure the shaft, a disk is connected to an end of the shaft and located in opposite to the pull unit, the disk has a restriction slot in which an extension extending from the sleeve is inserted.

8. The exerciser as claimed in claim 7, wherein the restriction slot of the disk is a curved slot with an angle of 130 degrees defined between two extensions of the restriction slot.

9. The exerciser as claimed in claim 1, wherein the check valve and the adjustable control valve in the down-flow section of the resistance unit are arranged such that the check valve is located above the adjustable control valve, the check valve and the adjustable control valve in the up-flow section of the resistance unit is arranged such that the adjustable control valve is located above the check valve.

10. The exerciser as claimed in claim 1, wherein a pivotal member and a cable are connected between the bar and each of the handles, the pivotal member is connected between the bar and the cable, the cable is connected between the pivotal member and the handle.

* * * * *